United States Patent [19]

Hart

[11] Patent Number: 4,473,228

[45] Date of Patent: Sep. 25, 1984

[54] THREE-DIMENSIONAL COMBINATORIAL LINKAGE

[76] Inventor: John R. Hart, 2121 S. Priest Dr., Tempe, Ariz. 85282

[21] Appl. No.: 278,689

[22] Filed: Jun. 29, 1981

[51] Int. Cl.[3] ..... A63F 9/08

[52] U.S. Cl. ..... 273/153 S; 434/124

[58] Field of Search ..... 273/153 S, 155; 434/124

[56] References Cited

U.S. PATENT DOCUMENTS 3,690,672 9/1972 Dreyer ..... 273/155

FOREIGN PATENT DOCUMENTS 2405077 5/1979 France ..... 273/153 S 170062 12/1977 Hungary ..... 273/153 S 55-3956 1/1980 Japan ..... 273/153 S 55-8193 3/1980 Japan ..... 273/153 S 55-8192 3/1980 Japan ..... 273/153 S

*Primary Examiner*—Anton O. Oechsle

*Attorney, Agent, or Firm*—Harry M. Weiss

[57] ABSTRACT

A three-dimensional interchange linkage which permits any of a number of devices abounding a core to be laterally interchanged. A preferred form of the linkage is found in an icosahedral puzzle in which groups of five separate pieces can be rotated to re-order and re-arrange the pieces in the manner of a puzzle. The linkage which retains the pieces of the puzzle to the core while allowing lateral interchanges is essential to the operation of the puzzle.

7 Claims, 8 Drawing Figures

THREE-DIMENSIONAL COMBINATORIAL LINKAGE

BACKGROUND OF THE INVENTION

1. Field of the Invention

This invention relates generally to mechanical linkages for interchangeably connecting a plurality of members to the surface of a three-dimensional object, and, more specifically, relates to a linkage for a combinatorial puzzle.

2. Description of the Prior Art

In the past, mechanical linkages have been widely developed for a multitude of applications. A typical use of such a linkage was to couple various tool bits to a machine tool to permit the respective bits to be applied; in a particular sequence, to a workpiece. Such a device had typically utilized a turret configuration, with the respective bits radially arranged about a frame which was rotated to bring the appropriate tool to bear upon the workpiece. However, the number of tools which could be conveniently and reasonably connected to such a rotating frame was limited by the amount of space available on the frame. While larger frames were always possible, the increased size was often itself problematical. A need existed for a linkage which would permit a large number of tool bits to be interchangeably connected to a single tool holder in a compact configuration.

Puzzles have been another application where mechanical linkages have been found. Puzzles offered a challenge to both perspecuity and persistence. Since any puzzle, once solved, lost much of its allure, a need continued to exist for new puzzles to offer a challenge to those seeking such entertainment.

Combinatorial puzzles, which typically involved rearrangement of pieces from a disordered sequence into an ordered sequence, were popular. With the advent of low-cost plastic molding, combinatorial puzzles became widely available. A popular hand-held type of puzzle utilized a number of pieces slidably interconnected together into a matrix with a vacant position. The pieces could be rearranged by sliding any of a number of adjacent pieces into the vacant position, or "hole." Most often the pieces of such a puzzle had individual identification, and the challenge presented was to re-order the pieces into a desired message or sequence. Those adept at such matters were able to relatively easily master such a two-dimensional, sliding piece type combinatorial puzzle of typical hand-held dimensions. While larger, more complex, puzzles were possible, they were ungainly. A need continued to exist for a combinatorial puzzle which presented a greater challenge to an aspiring puzzle solver.

Coding devices, and corresponding decoding devices, which utilized various mechanical linkages had also been developed. While such coding devices depended upon their very complexity for the security which they provided, it was difficult to arrange a coding device of hand-held dimensions which was sufficiently complex so as to provide any substantial degree of difficulty to one trying to "break" the code. A need existed for a mechanical coding/decoding device which was of hand-held dimensions, but which was sufficiently complex as to render fortuitous solution of the code difficult.

SUMMARY OF THE INVENTION

In accord with a broadest aspect of the invention, it is an object to provide a linkage to interchangeably couple a plurality of devices to a three-dimensional core.

It is another object to provide a linkage for a three-dimensional combinatorial puzzle.

It is a further object to provide an icosahedral combinatorial puzzle.

It is again another object to provide a three-dimensional combinatorial puzzle entirely covered with identifiable pieces which can be rotated in groups of five about an axis passing through a point contiguous to each of the group of five pieces.

It is a further object to provide a more complex type of hand-held combinatorial puzzle than had been previously available.

It is an object to teach a method of interchangeably linking a plurality of members to the surface of a sphere.

DESCRIPTION OF THE PREFERRED EMBODIMENTS

In accord with a preferred embodiment of the invention, a linkage for permitting a three-dimensional lateral interchange of devices is disclosed, comprising: a spherical core; shoe means having a plurality of shoes respectively coupled to an individual one of the devices for sliding upon the surface of the core; and retaining means having a plurality of isolated caps for trapping each of the shoes upon the surface of the core in slidable freedom so that the devices can be laterally interchanged.

In accord with another embodiment of the invention, a three-dimensional combinatorial puzzle is disclosed, comprising piece means having a plurality of pieces respectively provided with an indicia bearing face for defining a combination of the indicia; and linkage means for permitting groups of five of the pieces to be rotated so that each of the pieces can be shifted to provide altered combinations of the indicia.

In accord with a further embodiment of the invention, a method of rearrangeably connecting a plurality of devices to the surface of a three-dimensional object is disclosed, comprising the steps of: resting an arcuate inner surface of each of a plurality of shoes upon the generally spherical outer surface of a core; slidably trapping each of the shoes beneath at least one of a plurality of isolated caps securely coupled to the core; and mounting individual ones of the plurality of the devices to each of the plurality of shoes so that the devices are coupled to the core in laterally interchangeable freedom.

The foregoing and other objects, features and advantages of this invention will be apparent from the following, more particular description of the preferred embodiments of the invention, as illustrated in the accompanying drawings.

THE SPECIFICATION

Figure 1:
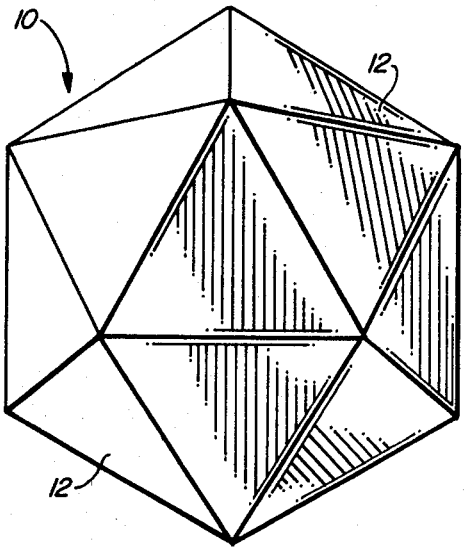
FIG. 1 is a perspective view of an assembled three-dimensional, interchangeable linkage formed in the shape of an icosahedral prism.

FIG. 1 is a perspective view of a preferred embodiment of a three-dimensional interchangeable linkage, in the form of an icosahedral puzzle as illustrated generally by reference number 10. The puzzle 10 has a number of faces, being twenty in number. Each of the faces is individually formed by one of a plurality of pieces 12. The puzzle 10 forms a regular prism, with each of the faces having the shape of an equilateral triangle. The exposed face of each of the pieces 12 forms a part of three pentagonal groups of faces. Each pentagonal group has an apex. As subsequently explained, each pentagonal group of the pieces 12 is rotatable about an axis passing through the apex of the particular group.

Figure 2:
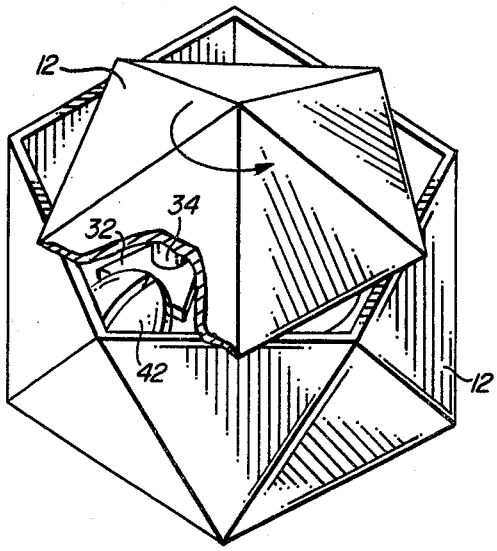
FIG. 2 is a partially sectioned perspective view of the prism of FIG. 1, showing a quintet of the interchangeable pieces being rotated as a unit.

Referring then to FIG. 2, a perspective view of the puzzle 10 is shown, with one pentagonal group of the pieces being rotated about its axis in the direction indicated by the arrow. Portions of one of the pieces 12 are removed to expose a shoe 32 and a retaining cap 42, which cooperate in a subsequently explained manner to connect each of the pieces 12 to the surface of a core 40 (Refer also to FIG. 5) in laterally interchangeable freedom.

Figure 3:
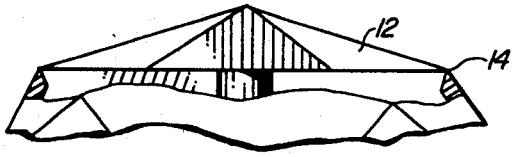
FIG. 3 is a partially sectioned elevational view of the prism of FIG. 1.

As further shown in the partially sectioned elevational view of FIG. 3, the puzzle 10 is arranged to permit the interior peripheral edges of the pieces 12, which combine to form the lower limit of a pentagonal group, to lie in and define a common plane 14. Thus as a pentagonal group is rotated upon the surface of the core 40, the underlying peripheral edges clear each of the adjacent pieces 12. Since each of the pieces 12 can be rotated as a constituent member of any of three different pentagonal groups, any particular one of the pieces 12 can be shifted and re-oriented to any other position on the surface of the puzzle 10.

By appropriately marking the respective faces of the individual pieces 12, a multitude of possible combinations can be presented to befuddle an aspiring puzzle solver. By specifically indentifying at least some of the pieces 12, a puzzle based on the ordering of any of a word, number message or color sequence can be formed with the puzzle 10. One skilled in the art will also readily observe that the linkage which enables the operation of the puzzle 10 can also be advantageously utilized as a coding or de-coding device, allowing encrypted messages to be recorded upon the various faces which form the puzzle 10. By re-ordering the pieces 12 of the puzzle 10 according to a first set of indicia recorded on the faces, a message defined by a second set of indicia recorded on the pieces 12 can be easily interpreted.

Figure 4:
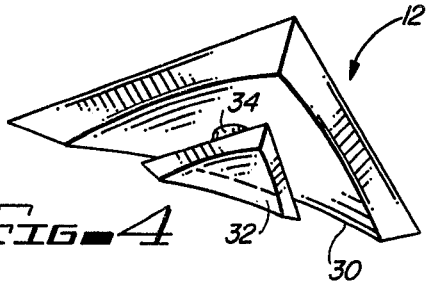
FIG. 4 is a perspective view of an interior side of a piece removed from the linkage of FIG. 1.

Referring also to FIG. 4, a perspective view of the lower portions of a typical piece 12 is shown. The piece 12 has a head 30, whose upper surface forms one of the visible faces of the puzzle 10. The piece 12 also has the shoe 32, coupled to the head 30 by a column member 34 (Refer also to FIG. 8). The shoe 32 has both outer and inner surfaces contoured in concentricity about the core 40. The inner surface of the shoe 32 is formed in the exact curvature of the core 40, permitting a slidable bearing relationship. The outer surface of the shoe 32 is also contoured, to permit slidable passage of the shoe 32 beneath the contoured lower surface of the retaining cap 42, as shown in FIG. 8.

Figure 5:
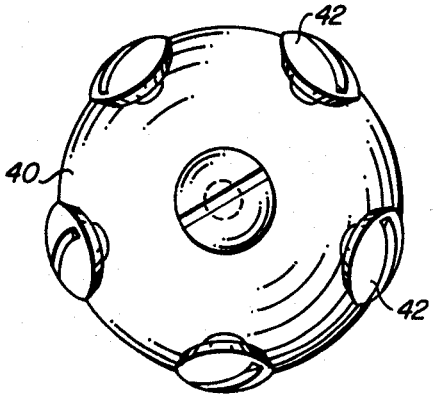
FIG. 5 is an elevational view of the core of the interchangeable linkage of FIG. 1.

In FIG. 5, a perspective view of the core 40 of the puzzle 10 is shown. The core 40 is the internal framework of the puzzle 10, and has a spherical outer surface to provide bearing support for each of the shoes 32. Also shown coupled to the core 40 are the retaining caps 42 which retain the shoes 32 in slidable contact with the surface of the core 40.

Figure 6:
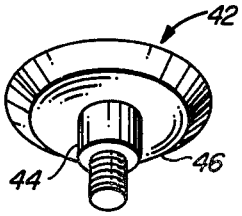
FIG. 6 is a perspective view of the inner surface of a retaining cap.
Figure 7:
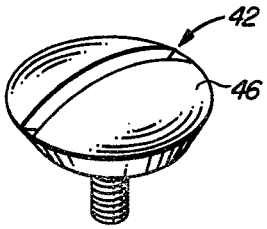
FIG. 7 is a perspective view of the outer surface of a retaining cap.

FIGS. 6 and 7 are respectively perspective views of the inner and outer surfaces of one of the retaining caps 42. A fastener, which can be an integral part of the cap 42 or can be a separate piece simply passing therethrough, is used in the embodiment shown to attach the retaining cap 42 to the body of the core 40. A shank 44 spaces a retaining flare 46 of the retaining cap 42 from the body of the core 40. Thus each of the shoes 32 is allowed lateral movement beneath one or another of the retaining caps 42. At the same time, the pieces 32 are each held in at a fixed radial distance from the center of the core 40. In the preferred embodiment, the outer surface of the retaining flare 46 is also contoured in concentricity with the body of the core 40, permitting clearance adequate for the interchange of pieces 12 beneath the correspondingly contoured lower surface of the head 30 of each of the pieces 12.

Figure 8:
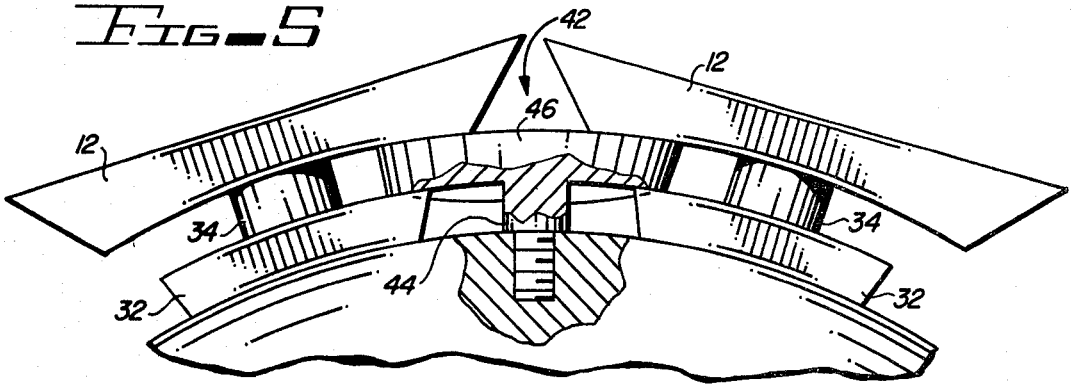
FIG. 8 is a sectional elevational view of a portion of the prism of FIG. 1.

Referring finally to FIG. 8, a sectional elevational view of the outer portions of the puzzle 10 is shown, revealing the fully assembled relationship of the core 40, one of the retaining caps 42, and two of the pieces 12. As can be seen, the retaining flare 46 overlies at least portions of each of the shoes 32. Thus each of the respective pieces 12 is trapped in slidable contact with the core 40. Also shown is the undercut nature of the peripheral edges adjoining the upper surface of each of the pieces 12, which undercut permits the pieces 12 to be rotated and shifted without collision with, or interference from, the adjacent pieces 12.

One skilled in the art will see various other applications for the linkage herein disclosed, such, for example, as the use of the linkage to provide a large number of interchangeable bits which are manually interchangeable and commonly connected . to the rotating drive of a machine tool. While the invention has been particularly described and shown in reference to the preferred embodiments thereof, it will be understood by those skilled in the art that various changes in form and detail and omissions may be made therein without departing from the spirit and scope of the invention.

I claim:

1. A three-dimensional combinatorial puzzle, comprising:

piece means having a plurality of pieces respectively provided with an indicia bearing face for defining a combination of said indicia; and linkage means having a speherical core for permitting any contiguous group of five of said pieces to be simultaneously rotated about a separate axis so that said pieces can be shifted to provide altered combinations of said indicia.

2. A game in accord with claim 1 wherein said linkage means comprising:

said core having an arcuate external surface;

shoe means provided with a plurality of shoes each having outer and inner surfaces concentrically disposed about said external surface for supporting said respective counters upon said external surface; and retaining means provided with a plurality of caps individually having an inner surface spaced from and concentrically disposed about said external surface for retaining each of said shoes in slidable contact with said external surface.

3. A game in accord with claim 2 wherein said piece means are further comprised of each of said pieces having;

a head having said face; and column means for spacing said inner surface of said head from said outer surface of a corresponding one of said shoes so that one of said caps is at all times interposed between at least a portion of said inner surface of said head and said outer surface of said corresponding one of said shoes.

4. A game in accord with claim 3, wherein said piece means are further comprised of each of said pieces having said head provided with a lower surface having concentricity with respect to said external surface.

5. A three-dimensional puzzle in accord with claim 4, wherein said linkage means is further comprised of said head having undercut edges defining said indicia-bearing face so that when said group of five of said pieces is rotated the moving ones of said edges pass over the adjacent stationary ones of said edges.

6. A method of rearrangeably connecting a plurality of devices to the surface of a three-dimensional object, comprising the steps of:

resting an arcuate inner surface of a shoe of each of twenty shoes upon the generally spherical outer surface of a core;

slidably trapping each of said shoes beneath at least one of a plurality of isolated caps securely coupled to said core; and mounting individual ones of said plurality of devices to each of said twenty shoes so that said devices are coupled to said core in interchangeable freedom.

7. A method in accord with claim 6 wherein said step of slidably trapping further comprising the step of:

forming an outer surface of each of said shoes in concentricity about said core; and slidably contacting portions of said outer surface of each of said shoes with at least a portion of an inner surface of said at least one of said plurality of isolated caps so that said pieces remain radially positioned with respect to said core while enjoying at least lateral freedom.

* * * * *